United States Patent [19]

Nordstrom

[11] Patent Number: 4,457,242

[45] Date of Patent: Jul. 3, 1984

[54] APPARATUS FOR POSITIONING THE WORKHOLDER OF AN AUTOMATIC SEWING MACHINE

[75] Inventor: Eric W. Nordstrom, Forest Park, Ill.

[73] Assignee: Union Special Corporation, Chicago, Ill.

[21] Appl. No.: 303,651

[22] Filed: Sep. 18, 1981

[51] Int. Cl.[3] ..... D05B 21/00

[52] U.S. Cl. ..... 112/121.12

[58] Field of Search ..... 112/121.12, 121.11, 112/275, 277, 158 E

[56] References Cited

U.S. PATENT DOCUMENTS 3,830,175 8/1974 Levor ..... 112/121.12

4,133,275 1/1979 Herzer et al. ..... 112/121.12

*Primary Examiner*—Peter P. Nerbun

*Attorney, Agent, or Firm*—John W. Harbst; John A. Schaerli

[57] ABSTRACT

An apparatus operable in cooperation with the logic circuitry of an automatic sewing machine for positioning a movable workholder in a predetermined position relative the sewing machine needle. The apparatus includes a workholder position sensor assembly and workholder direction sensor assembly operable in timed relation relative to one another and in positional synchronization with the movement of the workholder. Electrical circuitry is adapted to read the signals of both sensor assemblies and position the workholder at a predetermined location.

13 Claims, 9 Drawing Figures

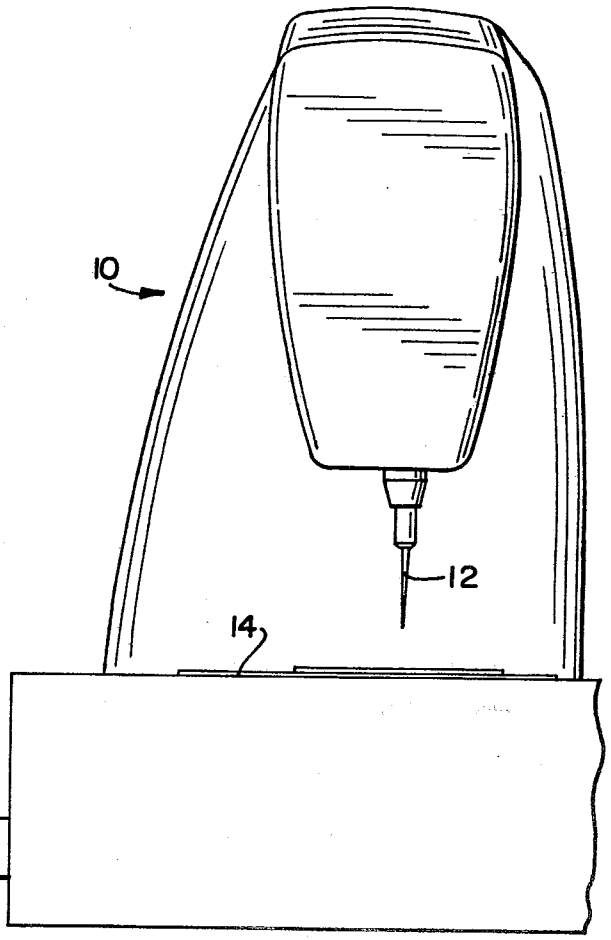
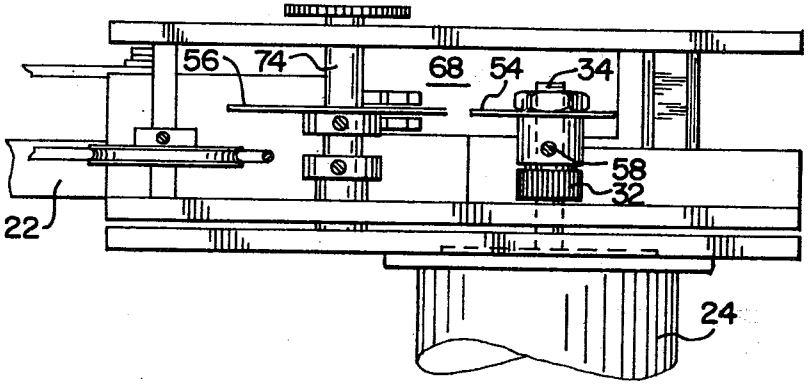
FIG. 4
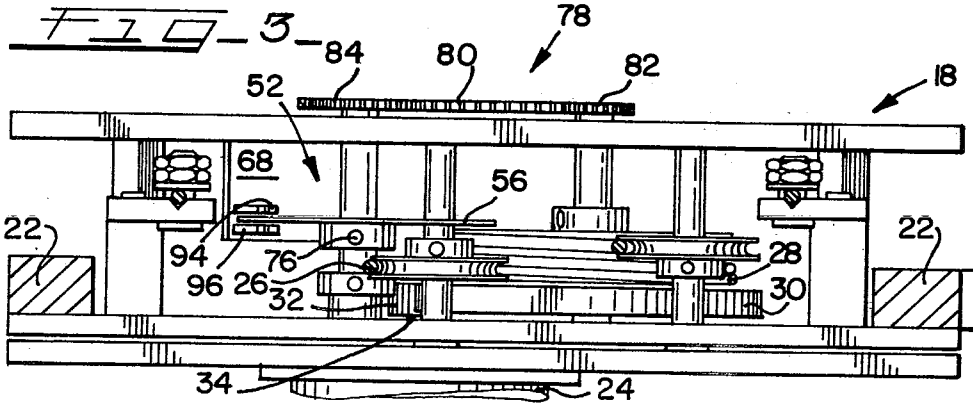
FIG. 5

FIG. 6
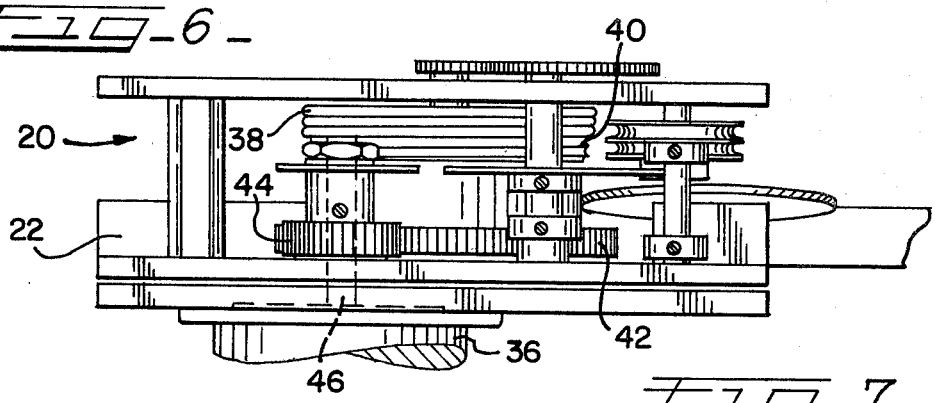
FIG. 7
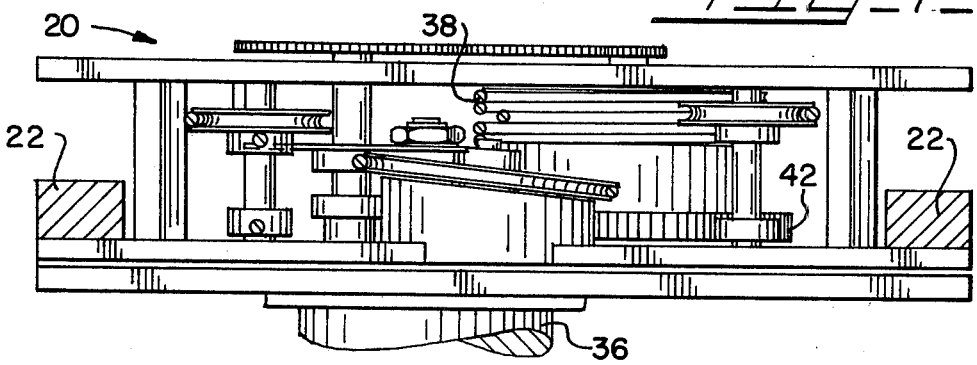
FIG. 9
| A | B | C | | D | | E | | F |
|---|---|---|---|---|---|---|---|---|
| 0 | 0 | 0 | 0 | 1 | 0 | 1 | 1 | 0 |
| 0 | 0 | 1 | 0 | 1 | 0 | 1 | 1 | 0 |
| 0 | 1 | 0 | 0 | 1 | 0 | 1 | 1 | 0 |
| 0 | 1 | 1 | 1 | 1 | 1 | 0 | 0 | 1 |
| 1 | 0 | 0 | X | 0 | 0 | 1 | 0 | 1 |
| 1 | 0 | 1 | X | 0 | 0 | 1 | 0 | 1 |
| 1 | 1 | 0 | 1 | 0 | 0 | 1 | 0 | 1 |
| 1 | 1 | 1 | 1 | 0 | 1 | 0 | 0 | 1 |
FIG. 8
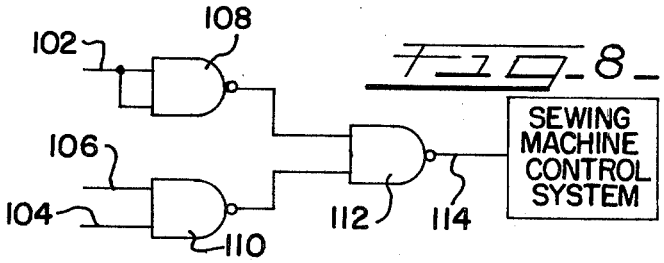

APPARATUS FOR POSITIONING THE WORKHOLDER OF AN AUTOMATIC SEWING MACHINE

FIELD OF THE INVENTION

This invention relates to sewing machines, in particular to automatic sewing machines having a workholder movable in two coordinate directions.

BACKGROUND OF THE INVENTION

The purpose of a homing assembly is to allow the control system of an automatic sewing machine to find a given "home" position from any random starting point within the range of motion of the physical system. To be effective, a workholder positioning mechanism must be operative throughout the full range of travel of the workholder. Like the present invention, U.S. Pat. No. 4,002,128 granted Jan. 11, 1967 to F. F. Yanikoski concerns an automatic sewing machine which employs stepper motors and a homing assembly having a single sensor assembly for positioning the workholder. In the Yanikoski device, one revolution of the stepping motor drive shaft was effective to move the workholder over its full travel approximating 4½" by 2½". With this limited range of movement, coupled with less than one full revolution of the stepping motor drive shaft, a homing assembly using a single sensor assembly was effective to accomplish the desired result. It will be understood that a homing assembly driven from the stepping motor and which includes a revoluable indicator disc must be sized and driven such that the disc's excursion or arcuate travel must be less than 360° for the full excursion of the mechanical system. An arcuate path of travel exceeding 360° would result in redundancy and ultimately inaccurate readings. In addition, the homing sensor's band of uncertainty must be considered in the design of a homing assembly.

The homing assembly shown in the above-identified patent does not lend itself to the present invention for the following reasons. With the present application of the invention, the full range of clamp movement approximates 10"×10". Thus, the single indicator disc concept used in the Yanikoski device is not practical with the instant invention. Because the clamp excursion of the present invention is so much larger than that used in Yanikoski, the diameter of the indicator disc would have to be significantly increased to not exceed its allowable 360 degree path of arcuate travel. The resultant size of such an indicator disc is impractical. To reduce the arcuate travel of a single disc indicator would require sacrificing the positional accurancy of the workholder relative the needle. Any reduction in the arcuate travel of a homing sensor magnifies its inaccuracy in the sensor's band of uncertainty, a result which must be avoided. Therefore, the homing assembly shown in the Yanikoski patent would not readily lend itself to incorporation within the automatic sewing machine here under consideration.

SUMMARY OF THE INVENTION

In view of the above, and in accordance with the present invention, there is provided an apparatus which is operative throughout the range of movement of the workholder without sacrificing positional accuracy. The problem of overcoming the heretofore mentioned constraints essentially is solved by providing a positioning assembly that includes more than one cooperatively arranged devices, that are capable of covering the complete positional area of the workholder over such a large area. The present invention contends with the limited arcuate travel requirement by providing a first indicator assembly which is operative through less than a 360° arc to approximate the position of the workholder and to sense the direction in which the workholder needs to be moved to achieve a given predetermined position. This assembly operates in synchronism with the movement of the workholder through its entire path of travel. Operatively associated in timed relation with the first sensor assembly is a second sensor assembly which operates in sychronism with the movement of the workholder through its entire path of travel but which will travel through more than 360° and is effective to sense the position of the workholder relative to the predetermined "home" position. A homing circuitry reads the signals from the first and second sensor means and is effective to influence the control system whereby stopping the workholder in its predetermined home position.

In view of the above, it is a primary object of this invention to provide an apparatus capable of positioning a workholder of an automatic sewing machine in a predetermined position relative the machine needle.

Another object of this invention is the provision of a positioning device capable of allowing the workholder of an automatic sewing machine a large travel capacity but, yet, accurate positioning at a predetermined position.

Further objects and advantages of this invention will become apparent from the description now to follow of the preferred embodiment thereof shown by way of example in the accompanying drawings in which:

FIG. 3 is a sectional view taken along Line 3—3 of FIG. 1;

FIG. 4 is a partial side view of the drive unit shown in FIG. 2;

FIG. 6 is a side view of said other workholder drive mechanism;

FIG. 7 is another side view of said other workholder drive mechanism;

FIG. 8 is a schematic illustration of the homing circuitry associated with the present invention;

FIG. 9 is a truth table of the homing sensor circuitry.

DETAILED DESCRIPTION OF THE PREFERRED EMBODIMENT

Figure 1:
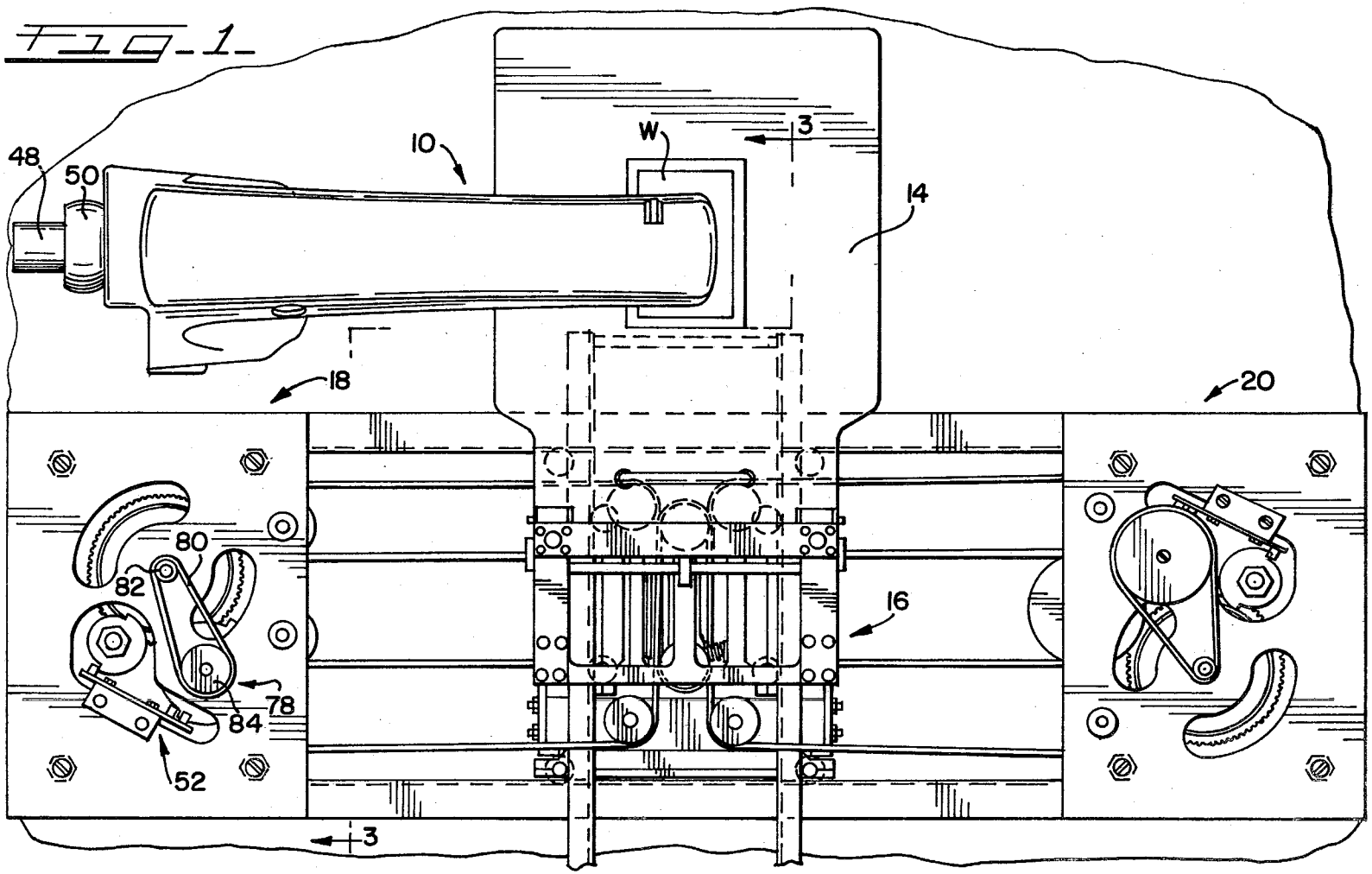
FIG. 1 is a top plan view of a portion of an automatic sewing machine.

Referring now to the drawings, wherein like reference numerals indicate like parts throughout the several views, there is shown a program controlled sewing machine 10 having a reciprocal needle means 12 (FIG. 3). Either one or a plurality of workpieces W to be sewn are held generally in a workholder 14 adapted to be carried by a movable transport or platform 16. The transport 16 is moved in a generally horizontal plane by a novel power translation system. This system is operated by a pair of drive units 18 and 20 which move the transport 16 in two coordinate directions. As seen in FIG. 1, the Y coordinate direction being aligned with the longitudinal axis of the sewing machine and the X coordinate direction being transverse to the longitudinal axis of the sewing machine.

Figure 2:
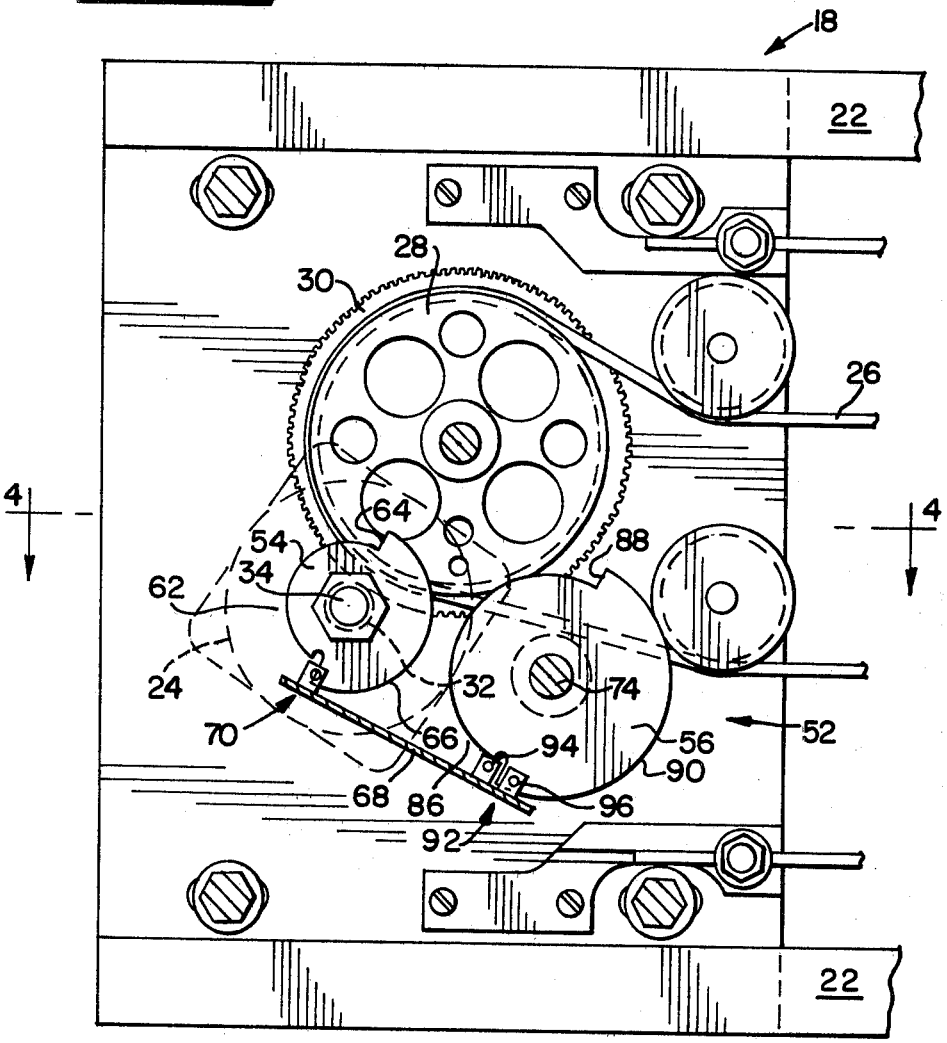
FIG. 2 is a sectional top plan view of one of two workholder drive units.

As seen in FIGS. 2, 3 and 4, the drive unit 18 serves to move the workholder in the Y coordinate direction. The drive unit 18 is carried on a frame 22 and includes a stepping motor 24 and a power translating system used to transmit the power from the stepping motor to the workholder. Preferably, the power translation system includes a cable 26 whose ends are secured to the carriage 16 which, intermediate its ends, is wound about and secured to a drive pulley 28. Intermeshing gears 30 and 32 serve to operatively connect the drive shaft 34 of the stepping motor to the drive pulley 28. In this manner, the rotational movement of the stepping motor shaft 34 is converted into linear movement of the cable 26 which ultimately moves the transport and thereby the workholder in the Y coordinate direction.

Figure 5:
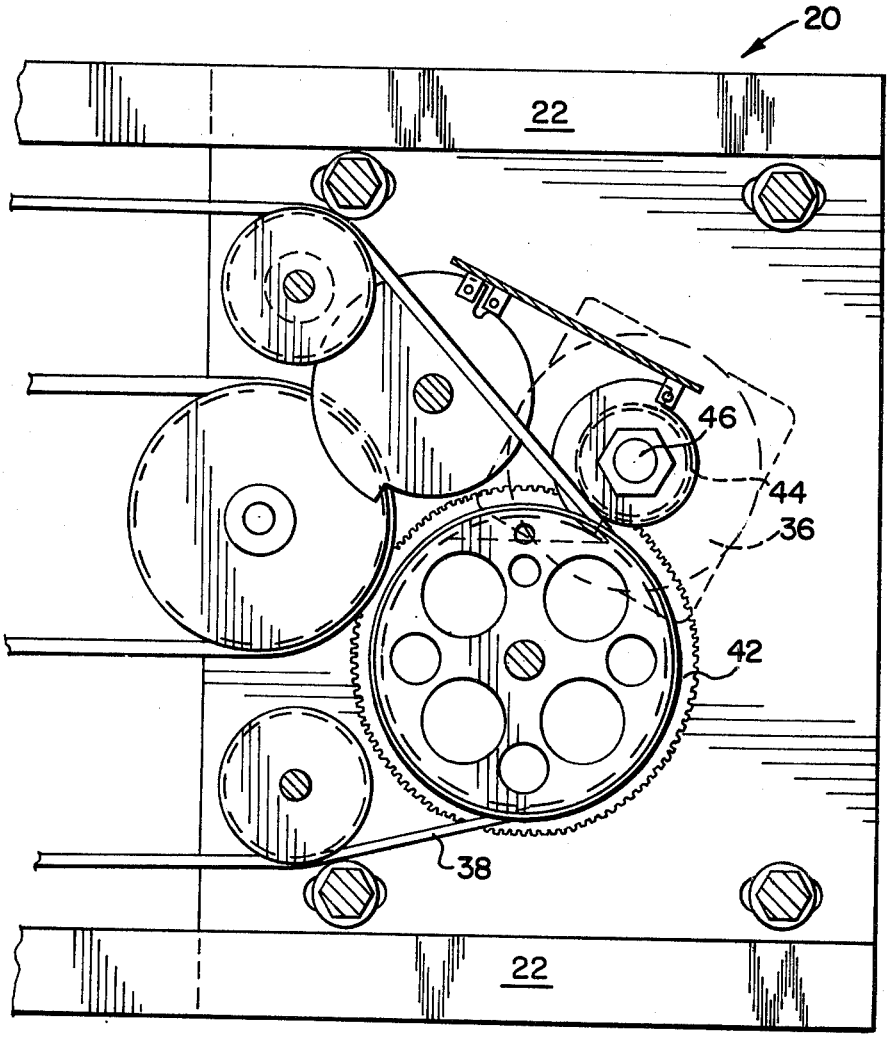
FIG. 5 is a sectional top plan view of the other workholder drive mechanism.

As seen in FIGS. 5, 6 and 7, the drive unit 20 serves to move the workholder in the X coordinate direction. The drive unit 20 is also carried on the common frame 22 and includes a stepping motor 36 and a power translation system used to transmit the power from the stepping motor to the workholder. Preferably, the power translation system includes a cable 38 which, intermediate its fixedly secured ends, passes around a series of pulleys carried by the transport 16 and is wound about and secured to a drive pulley 40. Intermeshing gears 42 and 44 serve to operatively connect the drive shaft 46 of the stepping motor to the drive pulley. In this manner, the rotational movement of the stepping motor drive shaft 46 is converted into linear movement of the cable 38 ultimately resulting in movement of the transport 16 and thereby the workholder in the X coordinate direction.

The stepping motors are driven by electrical signals from an operational logic system described in U.S. Pat. No. 4,051,794 issued Oct. 4, 1977 to W. P. Herzer et al: the full teachings of which are incorporated herein by reference but whose electrical circuitry may be different. These signals are synchronized to the reciprocal movement of the needle into and out of the workpiece by an electromechanical synchronization unit 48. As seen in FIG. 1, the unit 48 is connected to and driven by the sewing machine handwheel 50 and supplies synchronization signals to the electrical circuitry. In this particular embodiment, the workholder is moved in a predetermined pattern relative to the movement and position of the sewing machine needle. A sequence of instructions describing the desired pattern of movement for the workholder 14 is stored in a storage clement or memory unit having a plurality of randomly addressable storage locations. The instructions may include information utilized as commands for controlling movement of the workholder and reciprocation of the needle, and positional information for directing movement of the workholder relative the needle in variable distances along the two coordinate directions. Preferably the storage element is a programmable read only memory. In such devices the instructions stored in the various locations may be changed to describe a desired new pattern of movement. The storage element may also be for example, a randomly addressable read only memory in which the storage instructions may not be changed to describe a new pattern of movement. Solid state memory elements of both types are available and are preferred.

Electrical control circuitry is provided which reads information from as many of the addressable locations of the storage element as necessary to obtain a complete instruction for each movement of the workholder. It also converts each instruction into a sequence of pulses to be applied to the stepping motors and this drives the motors at a time, when as indicated by the synchronization unit 48, the needle 12 is not engaged in the workpiece. In this manner, movement of the workholder is timed not to adversely affect the movement of the sewing needle 12.

Each of the drive units is provided with a homing or workholder positioning assembly. The homing assembly for the drive units are utilized to position the workholder at a predetermined home location in the X and Y coordinate direction. This predetermined or home location may be preselected relative the needle by suitable adjustment of the X and Y homing assembly and would normally be chosen at a position to permit full range of movement by the workholder in a stitch pattern. Since the stepping motors are utilized in an open loop condition during a sewing operation, while under program control, the homing assemblies prevent cumulative errors in reference condition between consecutive sewing operations by starting each sewing operation at the same home position. Since the workholder and retained workpiece are positioned with extreme accuracy at the beginning and end of the sewing operation, auxiliary devices, such as slitting knives to cut button holes, may be utilized in conjunction with the machine even when a high degree of positional accuracy is required.

Since the homing or positioning assembly for both drive units may both be substanially the same, only the homing assembly associated with the Y drive unit 18 will be described in detail. The homing assembly generally designated 52, is best described in connection with FIGS. 2, 3, and 4. The homing assembly 52 comprises a revoluble high resolution sensor disc or indicator 54 and a revoluble low resolution sensor disc or indicator 56, both of whose motion is synchronized to the movement of the corresponding cables driving the workholder and in timed relation relative one another. The high resolution sensor flag or disc 54 is adjustably secured to the distal end of the stepping motor drive shaft 34 by appropriate fastening means 58 (FIG. 4). Thus, rotational movement of the stepping motor drive shaft 34 results in timed relation rotation of the disc 54 and the drive pulley 28. In the preferred embodiment, and as understood by persons skilled in the art, the intermeshing gears 30 and 32 are designed such that the sensor disc 54 rotates more than 360° during the full excursion of the workholder at a ratio of 6:1 relative to the drive pulley. As best seen in FIG. 2, sensor flag or disc 54 has a notch or cutout 62 defining a radially extending edge 64 intermediate the notch 62 and an outer portion 66 of the disc or flag 54. Fixedly mounted on a support plate 68 in a position adjacent the sensor flag 54 is a bistable sensor assembly 70. In the preferred embodiment, the sensor assembly 70 includes an optical sensor means 71 having spaced tines 72, one of which contains a light emitting diode, and the other a photo transistor. As shown, the outer portion 66 of the disc 54 is permitted to pass between the spaced tines of the sensor. Accordingly, the sensor 70 detects the presence or absence of the notch 62 and generates a signal which changes states as the disc edge 64 passes through the sensor tines 72 responsive to a change of condition in light passage or interruption between the tines in FIG. 8.

The low resolution sensor disc or indicator 56 serves to approximate the position of the workholder and to sense the direction in which the workholder needs to be moved to achieve a given position. The indicator 56 is adjustably carried on a shaft 74 the opposite ends of which are received in bores provided in the respective drive unit. Fastening means 76 serve to adjustably secure the disc 56 to the shaft 74. The shaft 74 is driven in timed relation with the high resolution indicator through a speed reduction means 78 (FIG. 1) such that the disc 56 carried thereby is driven through less than a 360° arc during the excursion of the workholder at a 12:1 ratio relative to the high speed indicator 54. As seen in FIGS. 1 and 3, the speed reduction means 78 includes a timing belt 80 that is entrained about suitably sized pulleys or gears 82 and 84 carried by the drive pulley 28 and shaft 74 respectively. Turning again to FIG. 2, the disc 56 is provided with a notch or cutout 86 defining a radially extending edge 88 intermediate the notch 86 and an outer portion 90 of the disc 56. Fixedly secured to the support plate 68, in a position adjacent the flag 56, is a second bistable sensor assembly 92. In the preferred embodiment, the sensor assembly 92 includes two optical sensor means 94 and 96 each having spaced tines. One of the spaced tines in each optical sensor means contains a light emitting diode and the other a photo transistor. As shown, the outer portion 90 of the disc 56 is permitted to pass between the spaced tines of the sensors 94 and 96. Accordingly, each sensor detects the presence or absence of the notch 96 and generates a signal which changes states as the disc edge 88 passes through the tines of each sensor responsive to a change of condition in light passage or interruption between the tines.

In operation, depending upon the rotational position of the disc 56 and its disc edge 88, the output signal produced by the sensor assembly 92 provides an indication to a homing circuitry 100 (FIG. 8) of the present position of the edge 88 relative to the sensor assembly 92. The signal from the sensor 92 is utilized to determine gross directional information. That is, the signals received from the sensor means 94 and 96 determine the rotational direction, the motor shaft should be moved to drive the disc edge 88 toward the sensor assembly 92. Although rotating in timed relation with the direction indicator 56, because the indicator means 54 turns at a higher rate of speed, it provides precise positional information regarding the workholder. That is, depending upon the rotational position of the disc 54, and its disc edge 64, the output signal produced by the sensor assembly 70 provides precise positional information to the homing circuitry of the present invention of the edge 64 relative the sensor assembly 70.

The purpose of the homing circuitry is to allow the sewing machine's control system to find a predetermined "home" position from any random starting point within the range of motion of the physical system. This is accomplished by seeking the transition point between the signals received from the directional and positional sensor assemblies. The sensor means 71, 94 and 96 operate together with the homing circuitry 100 to locate the workholder 14 in a predetermined position relative to the needle 12. As schematically shown in FIG. 8, the sensors 94 and 96 associated with the low speed or direction indicator means 56 provide signals over lines 102 and 104 respectively. The sensor assembly associated with the high speed or position indicator means 54 provides a signal to the homing circuitry over line 106. The homing circuitry 100 makes the two sensor assemblies 70 and 92 appear as one to the control system of the machine. In the preferred embodiment, the output of sensor means 94 serves as an input to a NAND gate 108. The output of the other direction sensor and output from the position sensor serve as the inputs to another NAND gate 110. The output of the NAND gates 108 and 110 serve as inputs into another NAND gate 112. The output of the homing circuitry 100 which is the output of NAND 112 provides output signals over line 114 to the sewing machine control system, based upon the inputs from the optical sensor assemblies 70 and 92. These output signals indicate the direction in which the stepping motor must be moved to ultimately move and position the workholder in its home or predetermined position.

The table in FIG. 9 illustrates the combinational logic states of the sensor and resultant outputs of the gates 108 and 110 and the homing circuitry 100. In the table, column A represents the various inputs received by NAND gate 108 over Line 102. Column B represents the various input received by the NAND gate 110 over the line 104. Column C represents the various inputs to the NAND gate 110 received over line 106. Column D in the table represents the resultant output of NAND gate 108. Column E represents the resultant output of the NAND gate 110. Column F represents the output of NAND gate 112 which is reflective of the output of the homing circuitry.

In operation, and as schematically illustrated in FIG. 9, as the direction sensor 56 turns in either direction so that sensors 94 and 96 are either both uncovered or covered, the homing circuitry 100 produces a signal dependent on that received from both sensors 94 and 96 and disregards the state of the position sensor assembly 70. When the edge 88 of the indicator element 56 is in a position where sensors 94 and 96 are in different states and their logic output is the same as the state of sensor assembly 70, then the homing circuitry signals that the predetermined or "home" position has been achieved. The homing circuitry is effective in this instance to indicate to the control system that the workholder is in its predetermined "home" position, and no further signals should be delivered to the stepping motors so as to make them advance the workholder in any other directions. Thus, overshooting of the home position is avoided and a more precise positioning is achieved.

It will also be seen that the rotational position of either disc 54 or 56 and its respective disc edge may be adjusted through use of the fastening means so as to secure the disc in various rotational positions. Accordingly, depending on the angular position of the disc edge relative the sensor, the edge may be suitably adjusted to pass through the sensor tines for different rotational positions of the stepping motor drive shaft, and the corresponding different positions of the workholder relative the needle at the time of edge crossing. In this manner, the home position of the workholder relative to the needle may be readily modified, as desired. The operation of the x-homing assembly in conjunction with the control system and x-stepping motor for placing the workholder at its home position along the x-coordinate direction is similar to that described above for the Y homing assembly.

Thus, it is apparent that there has been provided, in accordance with the invention, an apparatus for positioning the workholder of an automatic sewing machine that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

Having thus described the nature of the invention, what I claim is:

1. A homing assembly for positioning a workholder of an automatic sewing machine at a predetermined home position, comprising:

a rotatable workholder direction indicating element;

a rotatable workholder position indicating element;

means mounted adjacent said direction indicating element for determining the rotatable position of said element and for generating a signal;

means mounted adjacent said position indicating element for determining the rotatable position of said element and for generating a signal;

means for moving said workholder in positional synchronism with the movement of said direction position indicator element toward said predetermined home position; and reading means responsive to said signals of both determining means for stopping the workholder at said predetermined home position.

2. A homing assembly according to claim 1 wherein said direction indicating element includes:

a shaped disc rotated in synchronism with the position of the workholder;

said determining means including a sensor assembly responsive to the rotating action of said shaped disc for indicating the rotation position of said disc and thereby the location of said workholder.

3. An automatic sewing machine having a pattern generation control system comprising:

a sewing needle;

a workholder for holding a workpiece to be sewn;

first driving means adapted to move the workholder in a first coordinate direction;

second driving means adapted to move the workholder in a second coordinate direction;

a homing assembly for positioning said workholder in a predetermined home position regardless of its starting position, said homing assembly being driven in positional synchronism with movement of the workholder in the first coordinate direction, said homing assembly comprising:

operative means including workholder direction and position indicator means connected to and driven by one of said driving means for continually determining direction and the position of said workholder anywhere within the pattern; and control means operative together with said operative means to stop the workholder at a predetermined home position.

4. Apparatus for positioning a movable workholder of an automatic sewing machine in either of two coordinate directions, comprising:

first bistable signal producing sensor means which operate as a function of the rotational position of an actuator member operatively driven in concert with the workholder for providing directional information regarding the workholder;

second bistable signal producing sensor means which operate as a function of the rotational position of a second actuator member driven in concert with the workholder for providing positional information regarding the workholder; and means responsive to both signal producing sensor means for stopping the workholder in a predetermined position.

5. The invention of claim 4 wherein said actuator member comprises a shaped disc and said sensor means include a light passed by said disc.

6. The invention according to claim 5 wherein said disc has a cutout portion.

7. An automatic sewing machine comprising:

a needle;

a workholder capable of movement relative to the needle;

a first drive unit for moving said workholder in a first coordinate direction;

a second drive unit for moving said workholder in a second coordinate direction;

positioning means for stopping said workholder in a predetermined position in said first coordinate direction, said positioning means comprising;

a first shaped disc rotating less than 360° in synchronism with the position of the workholder in the first coordinate direction;

a position reading means arranged adjacent to and providing an output signal in response to the position of said disc;

a second shaped disc rotating greater than 360° in synchronism with the position of the workholder in the first coordinate direction and in timed relation with the rotation of said first shaped disc;

a second position reading means arranged adjacent to and providing an output signal in response to the position of said second disc; and means responsive to both position reading means signals for stopping the workholder in said predetermined position.

8. An automatic sewing machine according to claim 7 wherein said first shaped disc is driven from said first drive unit and said second shaped disc is driven in timed relation to said first shaped disc.

9. An automatic sewing machine according to claim 7 wherein said second disc rotates at a ratio of 12:1 relative to said first shaped disc.

10. A homing assembly for positioning a movable workholder of an automatic sewing machine in either of two coordinate directions, comprising:

a first position indicating element revolubly driven in synchronous relation with the position of said workholder;

a second position indicating element revolubly driven in timed relation with but at different speed from the first position indicating element;

first sensor means mounted at a preselected rotational position relative the revoluble axis of said first position indicating element for determining the position thereof and thereby the position of said workholder and for generating a signal;

second sensor means mounted at a preselected rotational position relative the revoluble axis of said second position indicating element for determining the position thereof and for generating a signal responsive thereto; and means responsive to said first and second sensor means signals for stopping the workholder in a predetermined position.

11. An automatic sewing machine comprising:

a sewing needle;

a workholder adapted for movement in two coordinate directions relative to the needle;

a first drive means for moving said workholder in a first coordinate direction;

a second drive means for moving said workholder in a second coordinate direction;

first operative means connected to said first drive means for indicating the direction of movement of the workholder;

second operative means connected to said first drive means for indicating the position of said workholder;

means connected to said first and second operative means for stopping said workholder in a predetermined position relative to the needle.

12. An automatic sewing machine comprising:

a needle;

a workholder capable of movement relative to the needle;

a first drive unit for moving said workholder in a first coordinate direction;

a homing assembly for positioning said workholder in a predetermined position in a first coordinate direction, said homing assembly comprising;

first means operative driven in positional synchronism with movement of the workholder in the first coordinate direction for approximating the workholder position relative its predetermined position in said first coordinate direction and for generating a signal in response to its position;

a second means operative driven in timed relation with said first means operative for defining the location of said workholder in a first coordinate direction and for generating a signal; and means responsive to signals from said first and second means operative for locating the workholder in its predetermined position.

13. An automatic sewing machine according to claim 9 including:

a second homing assembly for positioning said workholder in a predetermined position in said second coordinate direction, said second homing assembly comprising;

third means operative driven in positional synchronism with movement of the workholder in the second coordinate direction for approximating the workholder position relative its predetermined position in said second coordinate direction and for generating a signal in response to its position;

fourth means operative driven in timed relation with said third means operative for refining the location of the workholder relative to its predetermined position is said second coordinate direction and for generating a signal; and means responsive to said third and fourth means operative for locating the workholder in its predetermined position.

* * * * *